US010053965B1

(12) United States Patent
Holland

(10) Patent No.: US 10,053,965 B1
(45) Date of Patent: Aug. 21, 2018

(54) CRUDE OIL PRODUCTION METHOD AND EQUIPMENT

(71) Applicant: Ronald A. Holland, Carlsbad, CA (US)

(72) Inventor: Ronald A. Holland, Carlsbad, CA (US)

( * ) Notice: Subject to any disclaimer, the term of this patent is extended or adjusted under 35 U.S.C. 154(b) by 497 days.

(21) Appl. No.: 14/680,550

(22) Filed: Apr. 7, 2015

Related U.S. Application Data

(60) Provisional application No. 61/976,294, filed on Apr. 7, 2014.

(51) Int. Cl.
*E21B 37/02* (2006.01)
*E21B 43/12* (2006.01)
*E21B 43/16* (2006.01)

(52) U.S. Cl.
CPC ..... *E21B 43/129* (2013.01); *E21B 37/02* (2013.01); *E21B 43/16* (2013.01)

(58) Field of Classification Search
CPC ..... E21B 43/129; E21B 43/16; E21B 37/02; E21B 37/04; E21B 37/045; E21B 37/06; E21B 37/08; E21B 37/10; E21B 37/00; B08B 9/02; B08B 9/04; B08B 9/043; B08B 9/0436; B08B 9/0554; B08B 9/027; B08B 9/055
See application file for complete search history.

(56) References Cited

U.S. PATENT DOCUMENTS

| | | | | |
|---|---|---|---|---|
| 2,201,680 | A * | 5/1940 | Haynes | B08B 9/0553 15/104.061 |
| 2,797,757 | A * | 7/1957 | Webre | E21B 37/02 15/104.16 |
| 2,862,776 | A | 12/1958 | Bowerman | |
| 3,724,337 | A | 4/1973 | Richardson | |
| 4,099,451 | A | 7/1978 | Blackwell | |
| 4,317,407 | A | 3/1982 | Blackwell | |
| 4,986,727 | A | 1/1991 | Blanton | |
| 6,554,580 | B1 | 4/2003 | Mayfield et al. | |
| 7,021,387 | B2 | 4/2006 | Lee | |
| 7,134,503 | B2 | 11/2006 | Lee | |
| 8,701,779 | B2 | 4/2014 | Kleppa et al. | |
| 2004/0089446 | A1* | 5/2004 | Sugden | E21B 37/10 166/227 |
| 2010/0294479 | A1* | 11/2010 | Shee | E21B 19/008 166/65.1 |
| 2010/0314594 | A1* | 12/2010 | Seow | B66D 1/36 254/333 |
| 2015/0101801 | A1* | 4/2015 | Budde | E21B 33/14 166/250.01 |

* cited by examiner

*Primary Examiner* — Brad Harcourt
*Assistant Examiner* — David Carroll
(74) *Attorney, Agent, or Firm* — Kenneth L. Green; Averill & Green

(57) ABSTRACT

A lipless tubular oil seal assembly uses a tubular type of seal. The new seals create only enough pressure against the casing to provide an adequate seal under most conditions and the small amount of oil that would leak by on the roughest well casing surfaces acts as a lubricant. The new seal has no lip so it cannot turn under and get stuck in the well casing like a cup seal, even under the roughest conditions.

20 Claims, 11 Drawing Sheets

CRUDE OIL PRODUCTION METHOD AND EQUIPMENT

CROSS-REFERENCE TO RELATED APPLICATIONS

The present application claims the priority of U.S. Provisional Patent Application Ser. No. 61/976,294 filed Apr. 7, 2014, which application is incorporated in its entirety herein by reference.

BACKGROUND OF THE INVENTION

The present invention relates in general to producing crude oil from small, low or non flowing wells and more particularly to a safe new improved technology for producing more oil from these wells at lower cost than the prior art.

The common way of producing oil from these wells is to lower steel tubing down into the well casing just above the perforations with the outer portion of a pump connected to the bottom end of the tubing. Then lower steel rod down into the tubing with the inner portion of the pump connected to its bottom end until the two portions of the pump mate. To pump the oil from the well into the tubing the rod is moved up and down about the length of the pump (an average of about three feet) by the electric powered pump jack at the wellhead. This method has many disadvantages; one of the important ones is that when the pump is unable to pump oil out of the well for almost any reason the whole string of rod and tubing has to be pulled back out of the well to repair the equipment. On the average these wells are about two thousand feet deep and the pieces of rod and tubing are screwed together about every twenty five to thirty feet. This requires a large rig (truck) with at least a forty foot retractable boom and a place to store, in a vertical position, about one hundred pieces of rod and tubing while the equipment is being repaired.

Another important disadvantage is that when crude oil starts to cool down solids start to precipitate from the liquid and clog up the passage ways for the oil to seep out of the formation, through the perforations in the casing, and into the well, slowing down the production. The oil in the formation is normally very hot and all in liquid form but, the steel rod and tubing that is left in the well full time cools down the oil in the bottom of the well by conducting heat to the surface much faster than the gas or oil it replaced.

Attempts have been made to produce oil using a method called "swabbing". This is accomplished by lowering a rubber cup seal (swab cup) on a mandrel down into the oil in a well on the end of a cable wound on a power wench at the well head; then pulling the cable, swab, and the oil up to the surface. This method is simple and does increase production but there are problems with the equipment that keep it from being practical.

The design of the cup seal used on the prior art oil well swabs comes from the cup seals used in hydraulic equipment but the application is very different. In hydraulic power equipment the cup seal moves along a smooth surface and is not usually required to move in the direction of the lip when under high pressure. Using a cup seal to pull a tall column of oil out of a rough well casing in the direction of its lip is obviously the wrong application for the following reasons.

The swab can be very hard on old well casing when it is pulling a tall column of oil out of the well. The pressure on the lip of the swab cup from the column of oil above and the friction against the rough casing causes the lip to exert a very large outward force on the inside wall of the casing. This can cause a break in the casing in the area of the salt water formations where it has been weakened by heavy corrosion from the outside. Also in some cases the large outward force on the wall of the casing by the lip can cause it to partially turn back under the base and stick the swab in the casing where it is almost impossible and very expensive to fish out.

The casing in the well is also screwed together about every thirty feet with couplings as it is dropped into the well hole before it is cemented into the earth which often leaves a small space between the ends of the casing large enough to catch the lip of the swab and stick it in the well casing, even with a short column of oil above it. When any of the above problems happen that can't be corrected the well usually has to be taken out of production and permanently plugged, which is a very expensive operation.

BRIEF SUMMARY OF THE INVENTION

The present invention addresses the above and other needs by providing a safe, new oil pulling technology using a tubular type of seal, without a lip. These new seals with their pressure balancing technology create only enough pressure against the casing to provide an adequate seal under most conditions and the small amount of oil that would leak by on the roughest surfaces acts as a lubricant. The new seal has no lip so it cannot turn under and get stuck in the well casing like a cup seal, even under the roughest conditions.

In accordance with one aspect of the invention, there is provided a method for oil recovery. The method includes dropping a well casing cleaning tool on an end of a cable, down into a bottom of said well casing, lifting the well casing cleaning tool, scraping foreign material off an inside surface of said well casing, pushing half of said foreign material into a hollow center of said well casing cleaning tool and the remaining portion of said foreign material passing around the outside of said well casing cleaning tool, a cable winder winding said cable back on a drum, guiding the cable through a rigid tube between the cable winder and said drum, pressing at least three rollers pressed tightly the cable and against said drum, lowering a lipless tubular oil seal assembly on the cable down into said well casing and into oil residing at the bottom of the well casing, and lifting said lipless tubular oil seal assembly and thereby extracting oil from said well casing.

Using this new method of production allows chemical treatment of the well whenever it is deemed necessary for as long as required at very low cost because the old tubing, rods, pump, and pumpjack are no longer needed and are removed from the well. A simple pressurized chemical treatment of the formation can be accomplished by lowering a special tool with one tubular seal at the top and one at the bottom down into the well to the formation level with the desired chemicals sealed between them. The upper tubular seal can slide down on the tool to the lower seal so that when the well is filled to the top with crude oil and the tool is over the perforations the chemicals are driven into the formation by the difference between the formation pressure and the pressure from the full column of oil above. In open, non flowing wells the formation pressure is not enough to push oil out of the well, therefore filling the well with oil over this special tool will push the chemicals through the perforations and into the formation.

When this new technology is applied to older wells the casing should, for best performance, be scraped reasonably clean before the new seal is lowered into the well. Therefore a new inexpensive system has been developed to remove most of the foreign material that builds up on the inside of the casing while using the pump jack for production. The new system includes a unique new well cleaning tool that does not need to be rotated but can be dropped down into the well on the end of a cable. It also includes a new specialized cable wench and power supply that can be used with both the new cleaning tool to first clean the well and then with the tubular seal to produce the oil.

It can be seen from the description of the prior art and the above summary of the present invention, how this unique, new concept for a crude oil production system and the specialized equipment to operate it on a well can overcome many of the inefficiencies and difficulties of the prior art.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
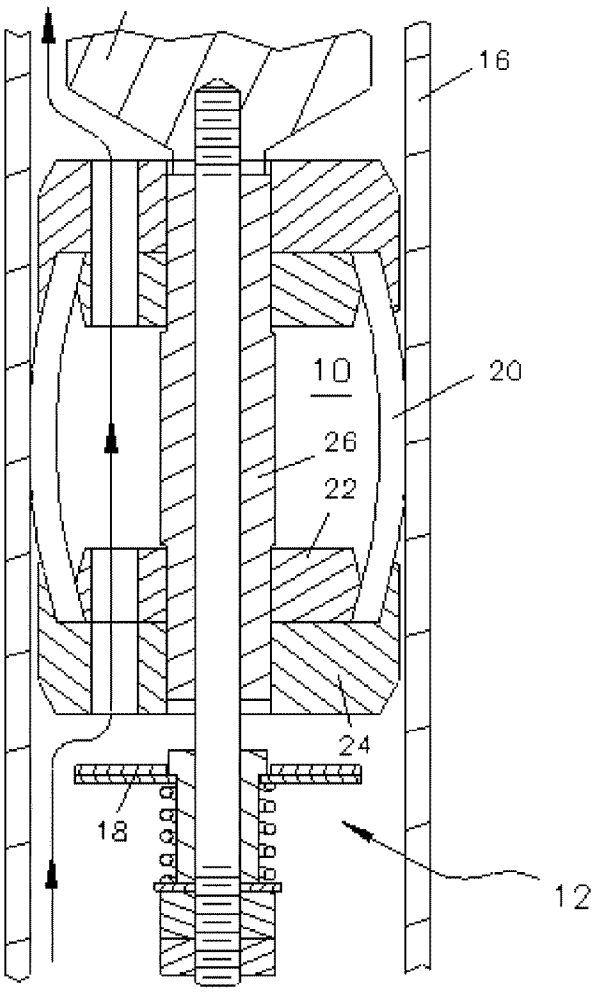
FIG. 1 is a cross-sectional side view depicting internal components of a tubular oil seal assembly for pulling crude oil from a well according to the present invention viewed in the position for descending the well.

FIG. 1 is a cross sectional view of the unique new oil pulling equipment of present invention in a well casing 16 with the tubular seal assembly 10 moved up off the seal plate assembly 12 for uninhibited movement down through the crude oil in the well. The seal plate assembly 12 is fixedly mounted in the mandrel 14 in a position that allows the seal assembly 10 to move up off of the seal plate 18 enough to allow liquid to flow rapidly through the seal assembly 10 and out around mandrel 14 as they are lowered down through the well.

The unique new tubular seal 20 of the present invention is composed of reinforced, oil impervious, molded rubber and is fixedly clamped at each end between the conical surfaces of the inner rings 22 and the end caps 24. The rings 22 and caps 24 are slip fit on the core 26 and allowed to move up and down a small amount to make up for expansion and contraction of the tubular seal 20. The outer diameter of seal 20 is larger in the center than it is at each end and creates a light seal against the inside of the well casing 16 in its natural state. Because seal 20 is relatively stiff this also helps keep the mandrel 14 centered when it is moving through the well casing 16.

Figure 2:
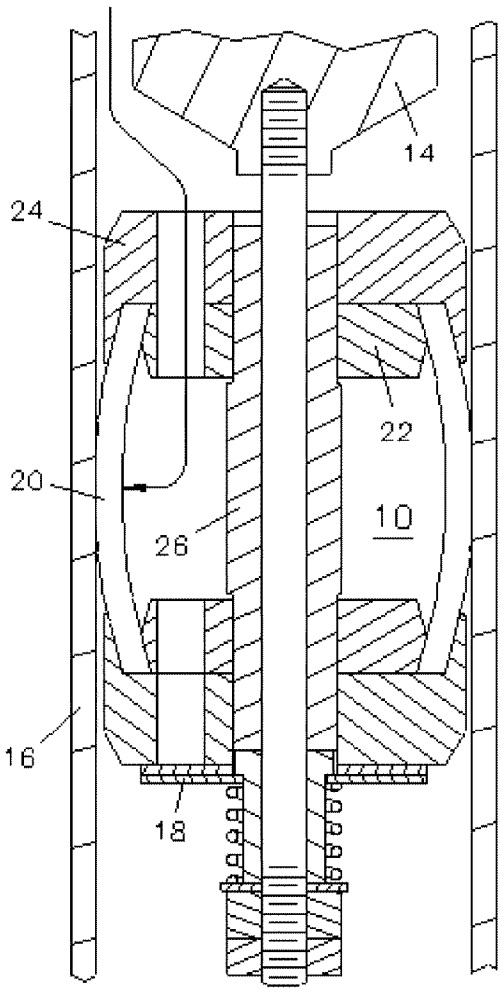
FIG. 2 is the same as FIG. 1 except that the tubular oil seal is in the position for pulling the oil out of the well.

FIG. 2 is the same as FIG. 1 except that it shows the seal assembly 10 down against plate 18 where it rests when the complete assembly of mandrel 14, seal assembly 10, and plate 18 is being pulled up through the well casing 16. In this position the liquid above and in seal assembly 10 will be trapped and pulled up with it. The pressure caused by the column of liquid above seal assembly 10 is allowed to reach the inside surface of seal 20, both above and below its contact point with casing 16. The pressure on the inside surface of seal 20 below the contact point presses seal 20 up against casing 16, but the pressure on the outside of seal 20 above the contact point keeps the pressure on the inside from pressing seal 20 up against casing 16 in the area above the contact point. Therefore as the seal 20 slides along the uneven surface of the old casing 16 the contact point will move up and down with respect to seal assembly 10, but the upper portion of seal 20 will be pulled away from any entrapment by its firm engagement with upper cap 24 and ring 22.

Figure 3:
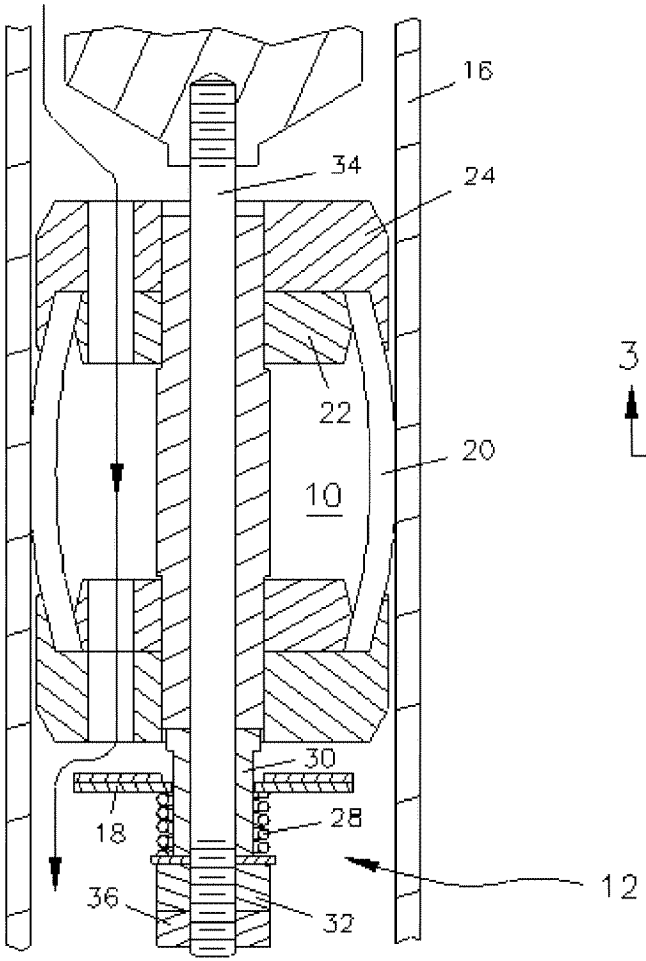
FIG. 3 is the same as FIG. 2 except that it demonstrates the ability of the seal assembly to dump access oil when starting up the well.

FIG. 3 is the same as FIG. 2 except that it shows how the seal plate assembly 12 can act as a pressure relief valve. If the tubular seal assembly 10 is accidentally dropped too far into the crude oil the pressure on the lower portion of the seal 20 will rise above the desired level when it is first pulled upward. This increased pressure will push the seal plate 18 down by compressing the spring 28 which will allow the seal assembly 10 to travel up through the oil to the desired level. The spacer 30 will not allow the seal assembly 10 to drop down to the seal plate 18 and block the flow of oil. The desired pressure can be adjusted with the nut 32 on the stud 34, and then locked into that value with lock nut 36.

Figure 4:
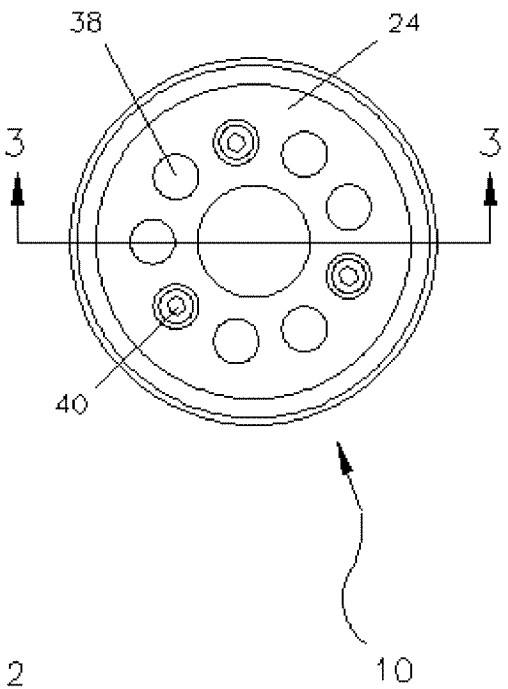
FIG. 4 is a top view of the tubular oil seal showing the six thru holes and the three bolts that hold it together at each end.

FIG. 4 is a top view of the tubular seal assembly 10 showing the six through holes 38 that allow the passage of crude oil when the seal assembly 10 is moving down though the well. It also shows the three bolts 40 that clamp the ring 22 to the cap 24 binding the ends of seal 20.

Figure 5:
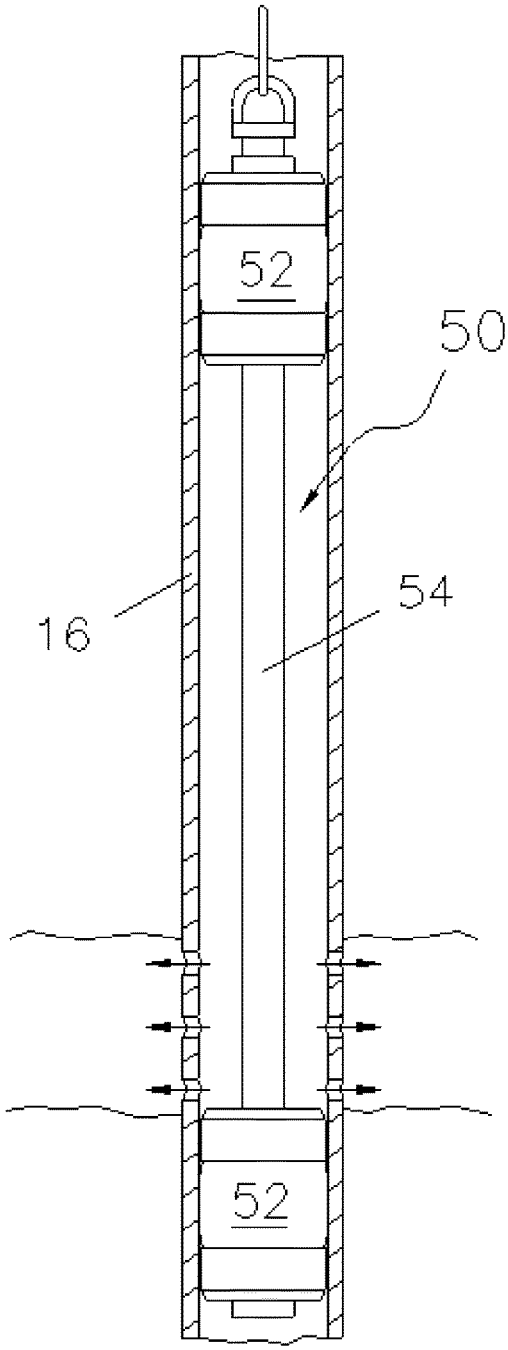
FIG. 5 is a side view of a tubular oil seal assembly for applying chemicals under pressure into the oil formation according to the present invention viewed at the bottom of the well in the position to begin pushing the chemicals into the formation.

FIG. 5 is a cross sectional view of a well casing 16 with the unique chemical treatment tool assembly 50 of the present invention full of chemicals between the two tubular seal assemblies 52 and lowered down in the well over the perforations. The seal assembly 52 on the top can slide down the tube 54 so that when the well 16 is filled to the top with crude oil and the tool is over the perforations the chemicals are driven into the formation by the difference between the formation pressure and the pressure from the full column of oil above.

Figure 6:
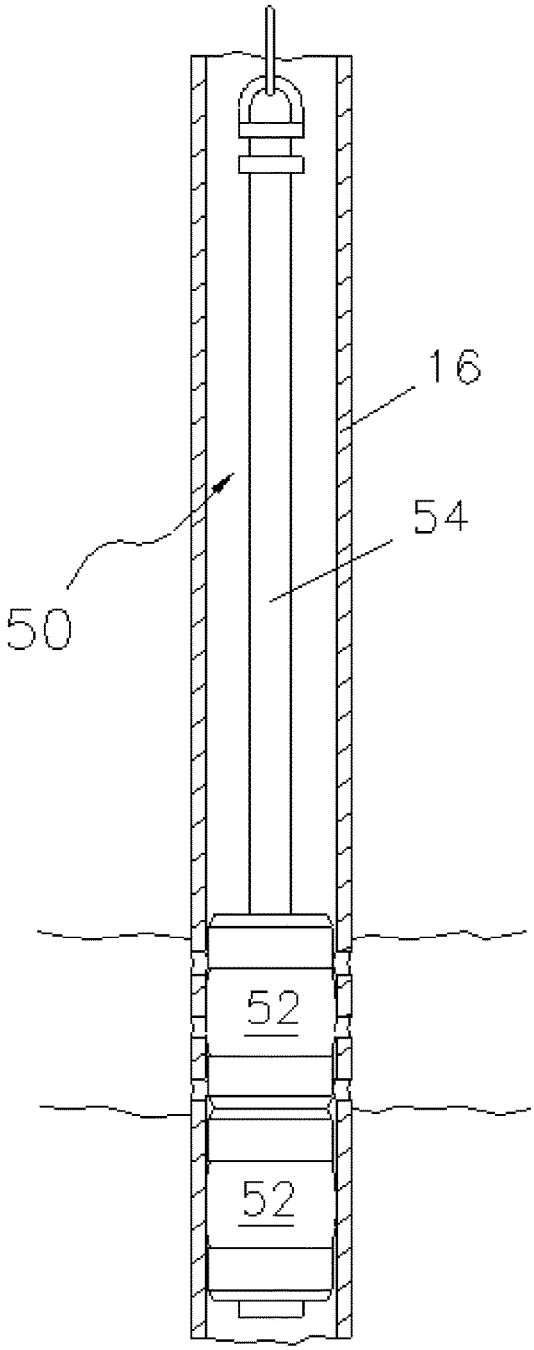
FIG. 6 is the same as FIG. 5 except that the top seal is at the bottom of its stroke when the chemicals under it are all pushed into the formation.

FIG. 6 is the same as FIG. 5 except that the top seal assembly 52 has forced all the chemicals into the formation and is resting on the lower seal assembly 52. When the treatment tool assembly 50 is being dropped down or pulled up through the oil in the well 16 the oil displaced can travel freely through the tube 54 which is open at both ends.

Figure 7:
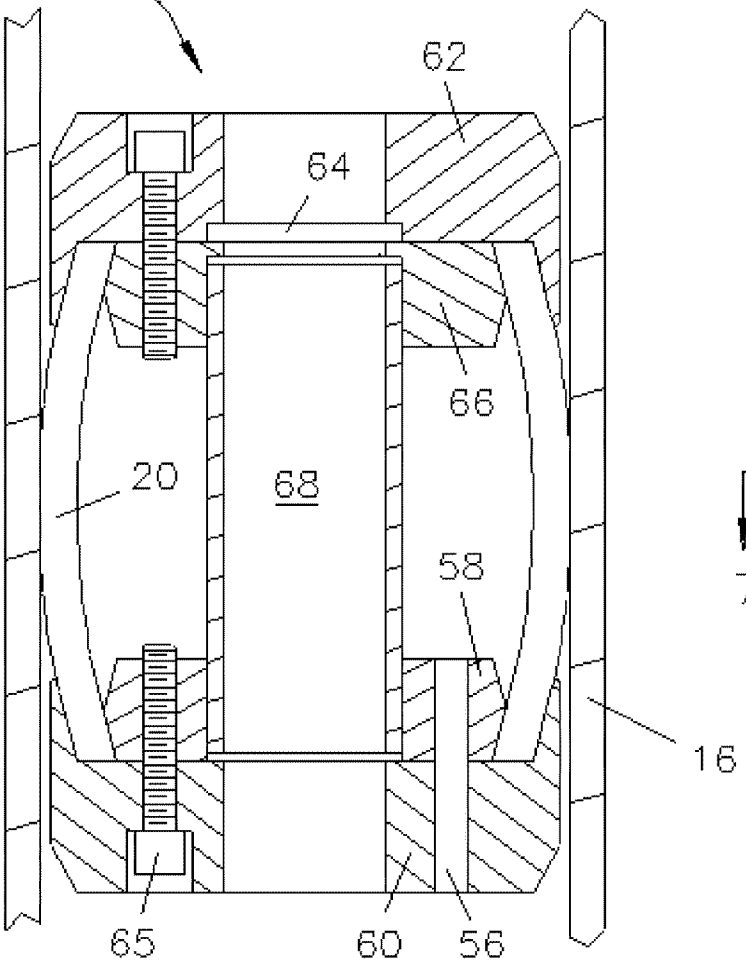
FIG. 7 is a cross-sectional side view depicting internal components of the tubular oil seal of FIGS. 5 and 6.

FIG. 7 is a cross sectional view of seal assembly 52 of FIGS. 5 and 6 in well casing 16. Seal assembly 52 is the same as seal assembly 10 of FIG. 1 except that it is made to slide up and down and seal on tube 54 of FIGS. 5 and 6, and it does not have the six thru holes 38 shown in FIG. 4. Instead it has one small hole 56 through the ring 58 and cap 60 on one end of seal assembly 52. On the other end of seal assembly 52 cap 62 has a groove 64 in the inside surface for an "o" ring to create the sliding seal on tube 54 of FIGS. 5 and 6. Ring 58 and 66 are slip fit over the short tube 68 and allowed to move up and down a small amount to make up for expansion and contraction of the tubular seal 20. Ring 58 and cap 60 with the small thru hole 56 are located at each end of the treatment tool assembly 50 of FIGS. 5 and 6 to allow the oil in the well 16 to pressurize the inside of seal 20 and the "o" rings to keep the chemicals out.

Figure 8:
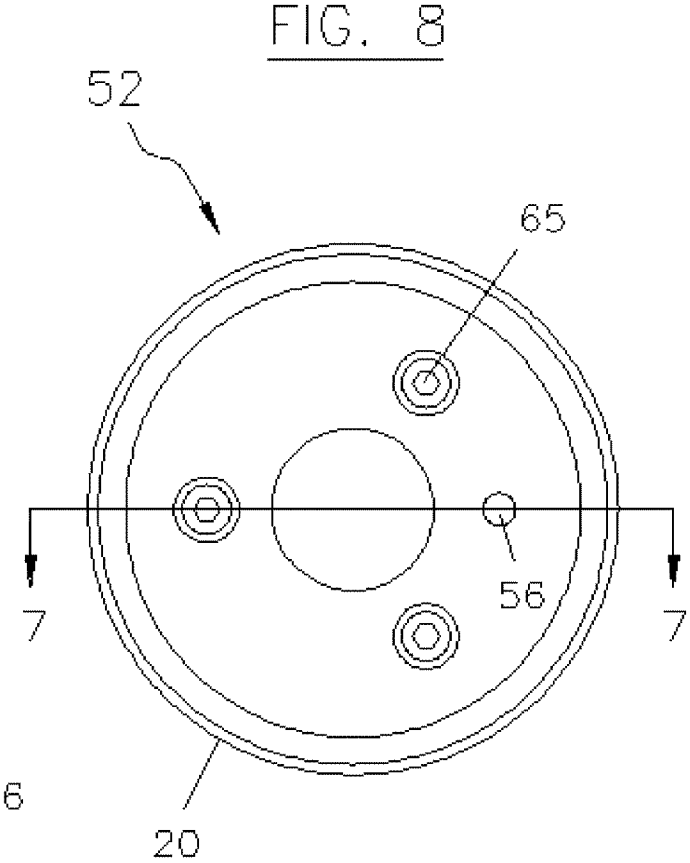
FIG. 8 is an end view of the tubular oil seal of FIG. 7 showing the location of the three bolts that hold it together at each end and the vent hole at one end.

FIG. 8 is an end view of the tubular oil seal 52 of FIG. 7 showing the location of the three bolts 65 that hold it together at each end and the small thru hole 56 at one end.

Figure 9:
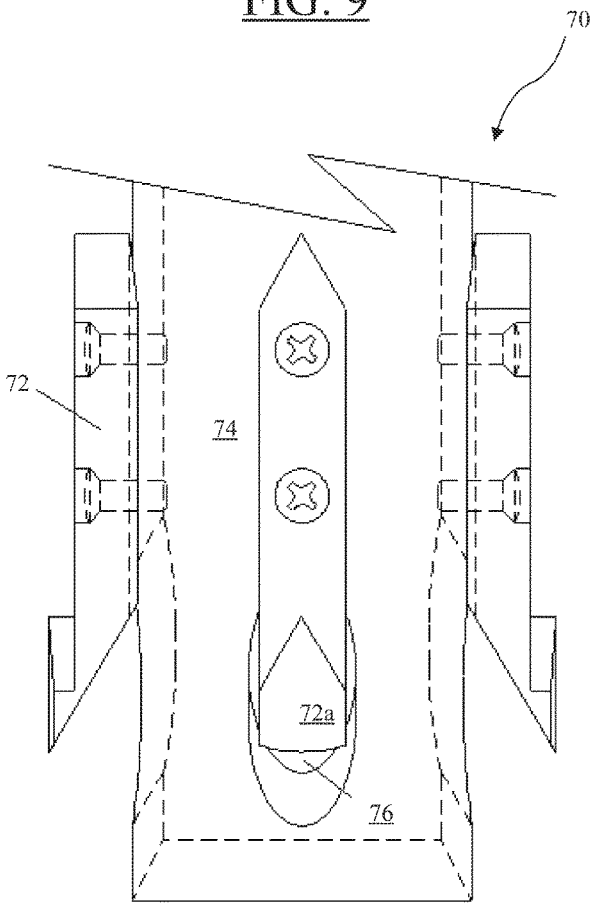
FIG. 9 is a side view of about the front quarter of an oil well cleaning tool according to the present invention showing the location and configuration of the front scraping teeth.

FIG. 9 is a side view of about the front quarter of the unique new well cleaning tool 70 of the present invention showing the configuration of the front scraping teeth 72. There are four teeth 72 rigidly mounted on the front of the tubular body 74, ninety degrees apart with respect to the center axis of the body 74. There are large thru holes 76 in the body 74 under the front of the teeth 72 so that the material scraped off the wall of the casing 16 can be pushed down inside the body 74 as the cleaning tool 70 is dropped down through the well casing 16.

Figure 10:
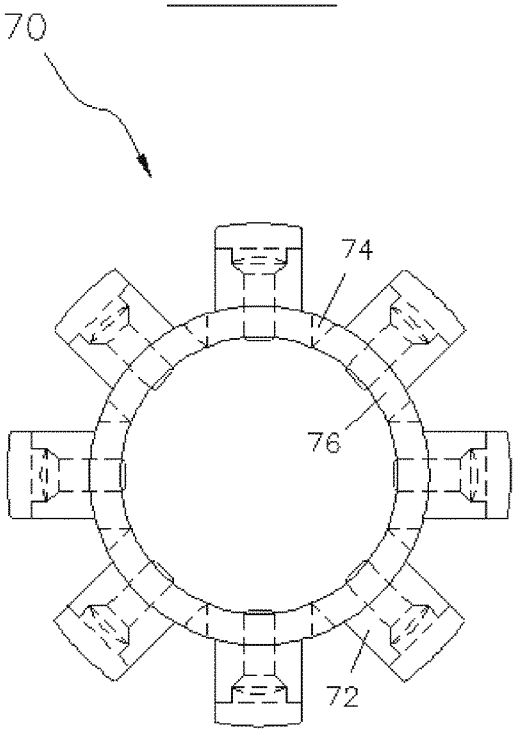
FIG. 10 is a front view of about the front half of the cleaning tool of FIG. 9 showing the location of the eight front scraping teeth.

FIG. 10 is a front view of the front half of cleaning tool 70 of FIG. 9 showing four more angularly spaced apart scraping teeth 72 mounted over holes 76 the same as the first set, but they are behind the others and rotated forty five degrees with respect to the them around the center axis of the body 74. Note that these staggered set of eight teeth 72 would only scrape about half of the material off of the casing 16 and send it into the center of the body 74.

Figure 11:
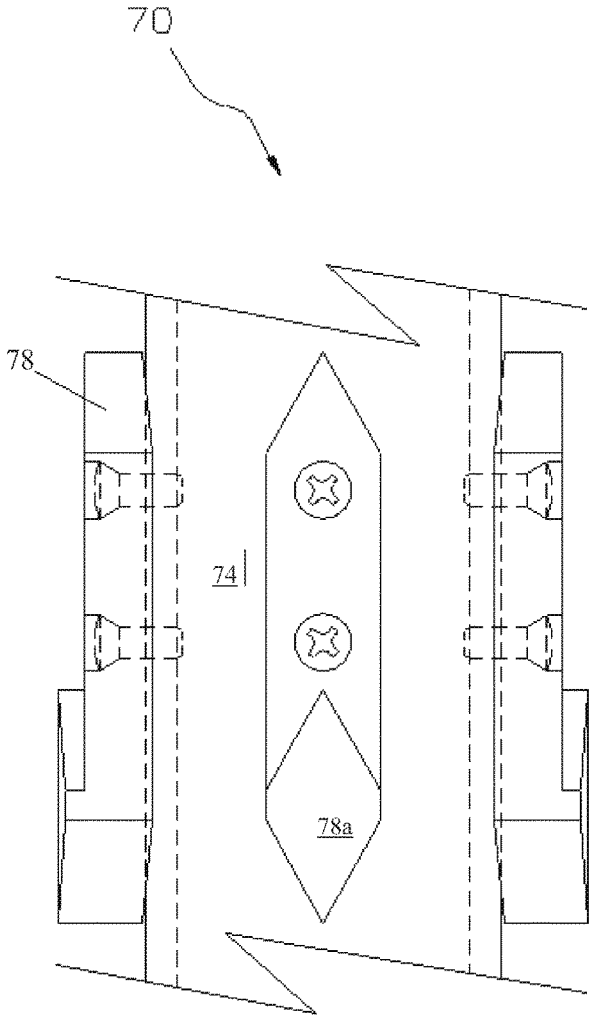
FIG. 11 is a side view of about one rear quarter of the cleaning tool of FIGS. 9 and 10 showing the location and configuration of half of the rear scraping teeth.

FIG. 11 is a side view of the next portion of the well cleaning tool 70 of FIGS. 9 and 10 showing the configuration of the rear scraping teeth 78. Like the front teeth 72 of FIGS. 9 and 10 there are four teeth 78 rigidly mounted on this portion of the tubular body 74, ninety degrees apart with respect to the center axis of the body 74. But they are rotated twenty two and one half degrees around the center axis of the body 74 with respect to the front teeth 72. The rear teeth 78 are shaped in the front to push the material they scrape off the inside wall of casing 16 to each side leaving it on the outside of the body 74.

Figure 12:
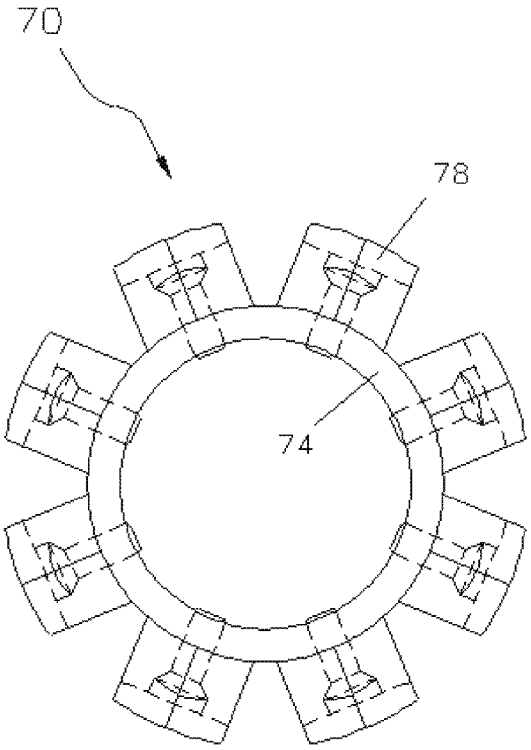
FIG. 12 is a front view of about the rear half of the cleaning tool of FIG. 9, thru 11 showing the location of the eight rear scraping teeth.

FIG. 12 is a front view of the rear half of cleaning tool 70 of FIGS. 9, 10, and 11 showing four more scraping teeth 78 mounted on body 74 the same as the first set, but they are rotated forty five degrees with respect to the first set around the center axis of the body 74. Note that these eight teeth 78 scrape the other half of the material off of the casing 16.

Figure 13:
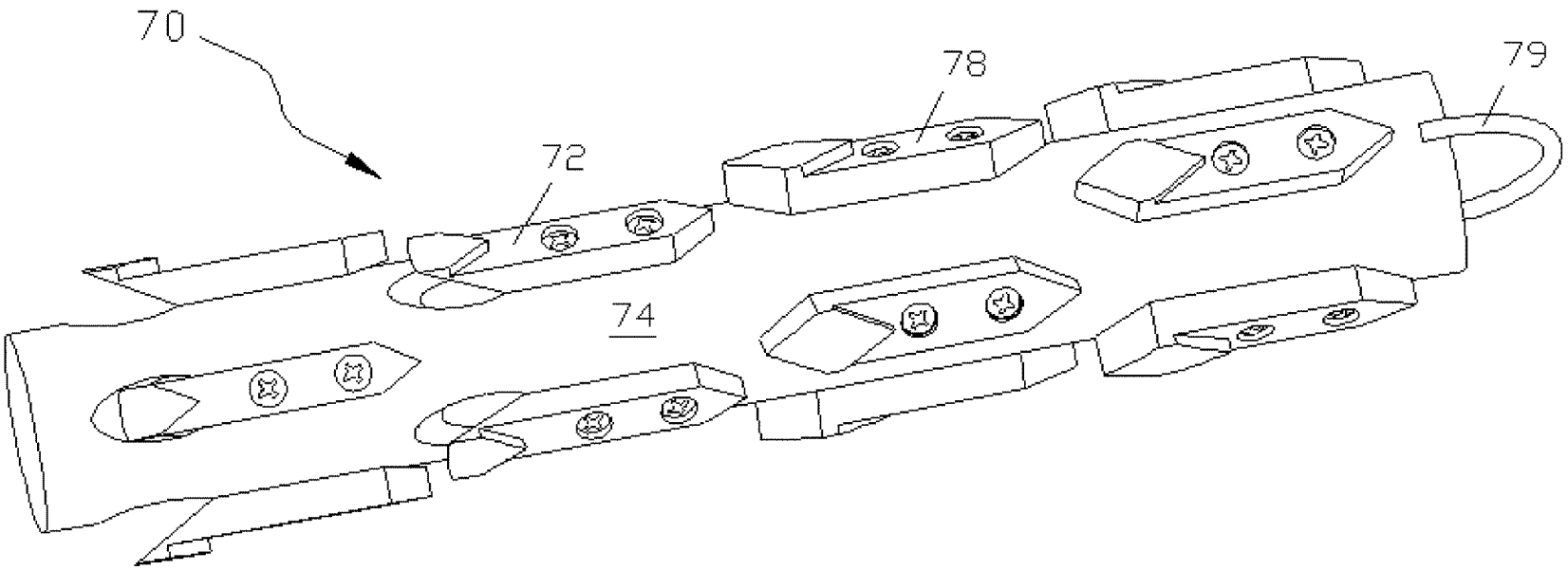
FIG. 13 is a perspective view of the whole well cleaning tool of FIG. 9 thru 12 showing both front and rear teeth and there location with respect to each other.

FIG. 13 is a perspective view of the whole well cleaning tool 70 of the present invention showing both front scraping teeth 72 and rear scraping teeth 78 and there location with respect to each other. It also shows the loop 79 on the back of the body 74 for attaching the cable (not shown) to pull the cleaning tool 70 out of the oil well casing 16. Buy pushing the scraped material into the center of the body the front teeth 72 cut open groves for the rear teeth to push their scraped material into, which keeps the scraped material from building up and jamming the tool 70 in the well 16 as it does when little or none of it is pushed into the center.

Figure 14:
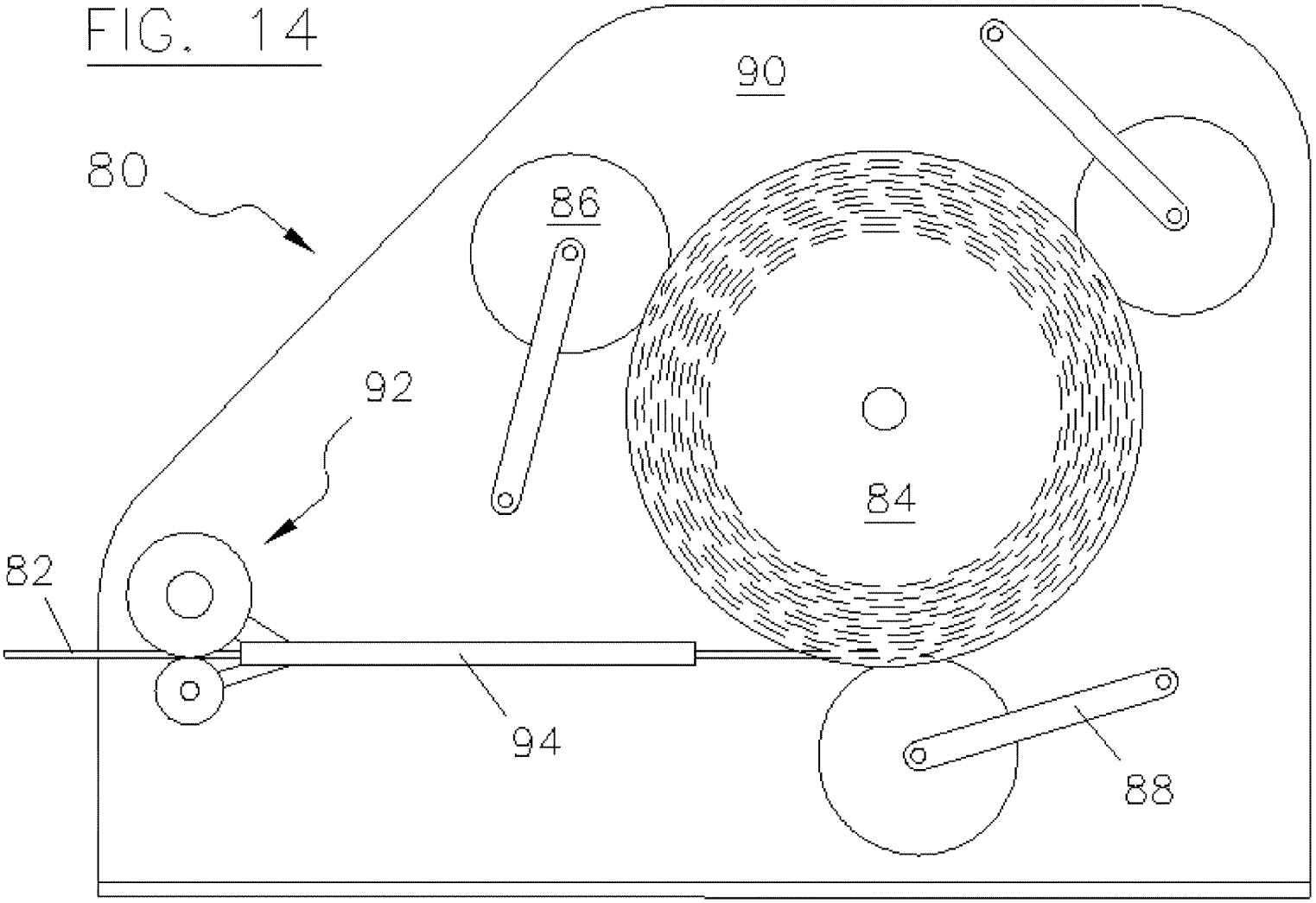
FIG. 14 is a side view of a powered cable wench showing only parts of the wench that help explain the function and unique aspect of the present invention, such as the three pressure rollers and the rigid tube from the winder to the drum.

FIG. 14 is a side view of a powered cable winch 80 showing only parts of the winch that help explain the function and unique aspect of the present invention. In this view the cable 82 is fully wound on the drum 84 with three rollers 86, that are almost the width of the drum 84, spring loaded against the outer layer of cable 82 and spaced no greater than one hundred and forty degrees apart with respect to the center axis of rotation of the drum 84. The rollers 86 are rotationally mounted on one end of arms 88 which are rotationally mounted on the other end on frame 90. The cable 82 is wound evenly on the drum 84 by a state-of-the-art cable winder 92 which is rotationally mounted on the frame 90. It was discovered that if a rigid tube 94 is mounted on the cable winder 92 over cable 82 between the winder 92 and the drum 84 on this configuration of a cable wench 80 that the cable 82 will not slack between the winder 92 and the drum 84 and will wind evenly even if it is greatly slacked leading up to the winder 92.

Figure 15:
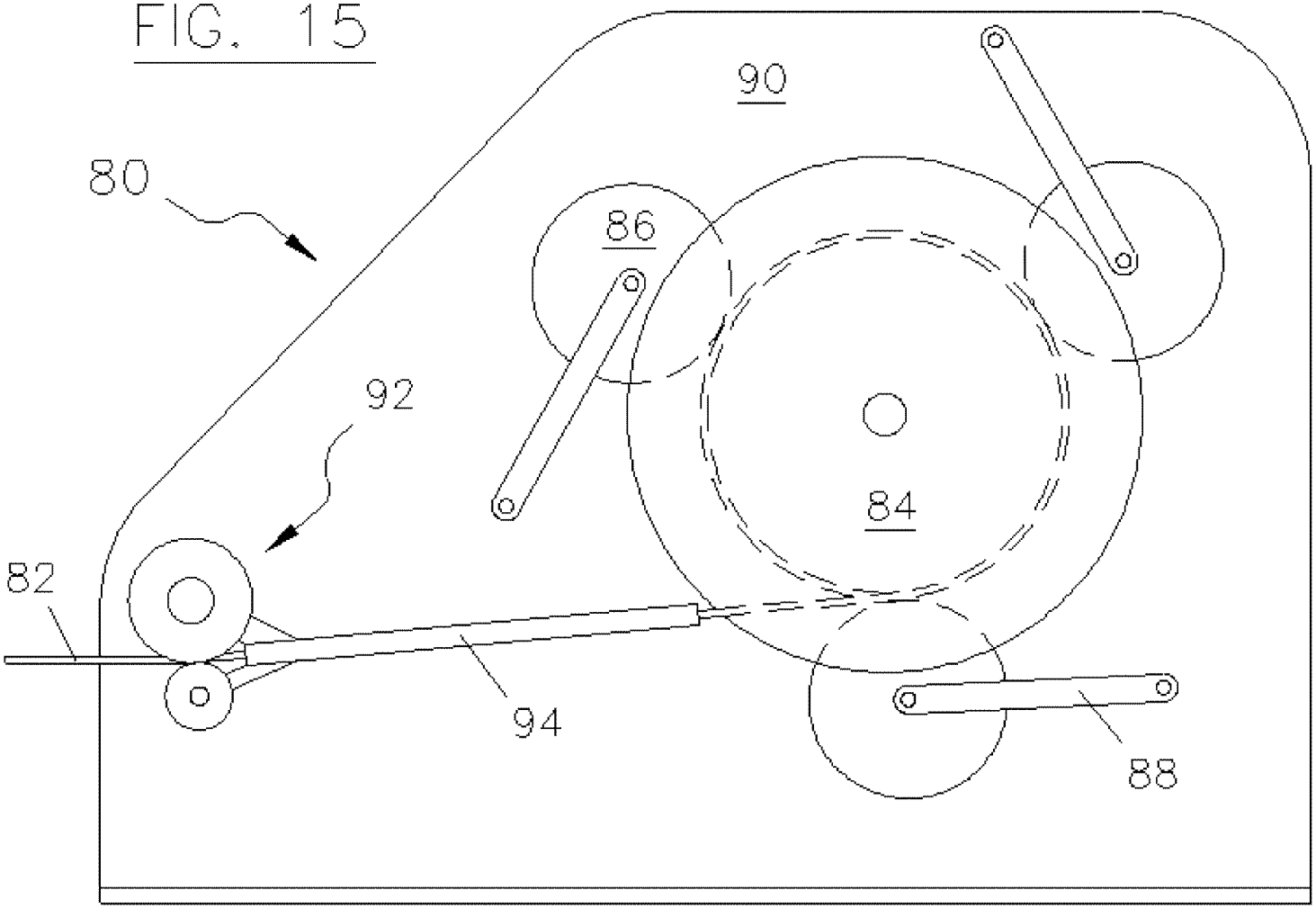
FIG. 15 is the same as FIG. 14 except that it shows the position of the rollers and the tube when the cable is almost all wound off the drum.

FIG. 15 is the same as FIG. 14 except that it shows the position of the rollers 86 and the tube 94 when the cable 82 is almost all wound off the drum 84. Prior art cable winches often fail to wind the cable correctly if much slack occurs between the cable winder and the drum. With one roller 86 pressed against the cable just after it rolls on the drum and the other two in the correct position the three rollers 86 and the tube 94 keep any cable slack from occurring on the winch 80 forcing the cable to wind correctly.

Figure 16:
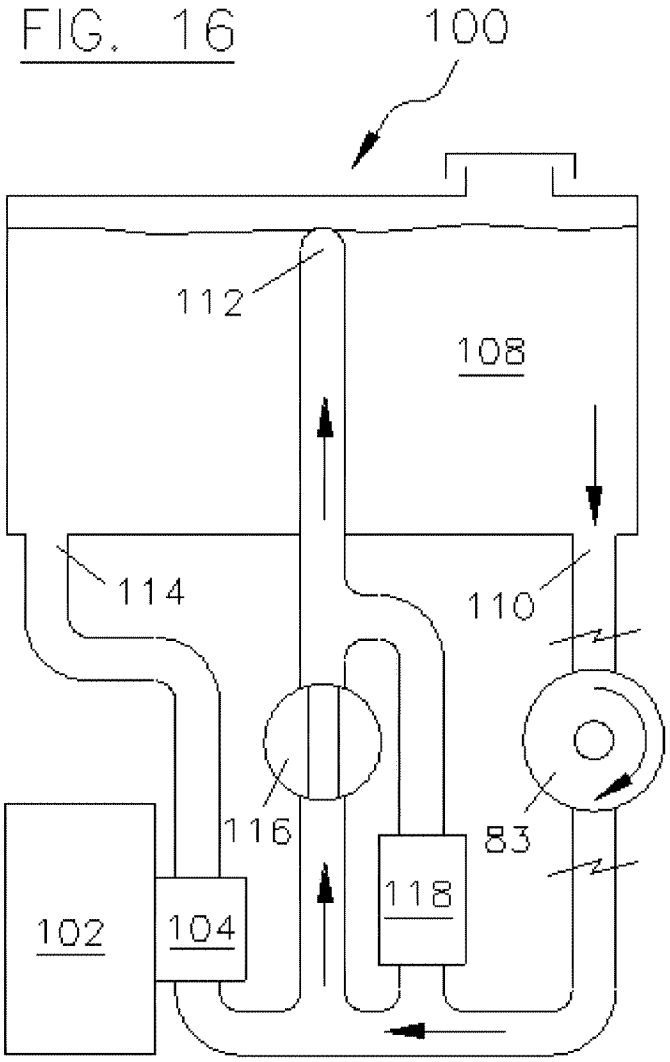
FIG. 16 is a circuit diagram of a hydraulic power supply according to the present invention that shows the unique flow of fluid for this special application of controlling a cable wench while it is dropping a heavy weight down an oil well at high speed.

FIG. 16 shows the circuit diagram of a unique new hydraulic power supply 100 of the present invention that solves the disadvantages of the prior art for this special application. If cable winch 80 of FIGS. 14 and 15 is driven by the hydraulic motor/pump 83 and it is powered by the hydraulic power supply 100, then it is a definite disadvantage to use the motor/engine that operates the hydraulic power supply to drop the cleaning tool 70 of FIG. 13 or the tubular seal assembly 10 of FIG. 1 down to the bottom of the well 16. The motor/pump 83 shown in FIG. 16 is not part of the hydraulic power supply 100, it can be mounted on cable winch 80 driving drum 84 and being driven by drum 84, however it is shown in this diagram for clarification of the unique circuit for this special application.

Referring to FIG. 16, when motor/engine 102 and pump 104 are not turning and a heavy tool is being dropped down the well 16 motor/pump 83 is operating as a pump which is receiving fluid from port 110 at the bottom of the tank 108 and pumping it through throttle valve 116 and port 112 back into tank 108. The pressure relief valve 118 will not open as long as the throttle valve 116 is open or the weight being dropped into the well 16 is not over sized.

Figure 17:
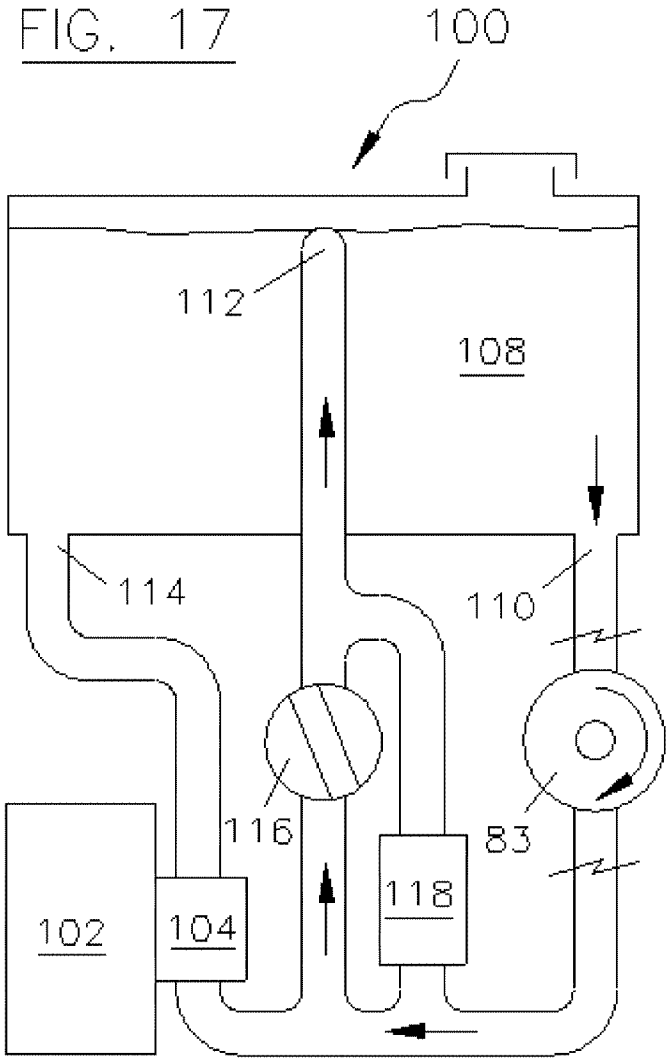
FIG. 17 is the same as FIG. 16 except that it shows how the speed of the weight can be more safely regulated or stopped with this new unique circuit.

FIG. 17 is the same as FIG. 16 except that the throttle valve 116 is partially closed which is slowing down the pump 83 and heating up the fluid until it is completely closed and the pump 83 is stopped. Therefore port 112 should empty into the top of the tank 108 where the warm fluid would mix with the other fluid and cool down before it returns to port 110.

Figure 18:
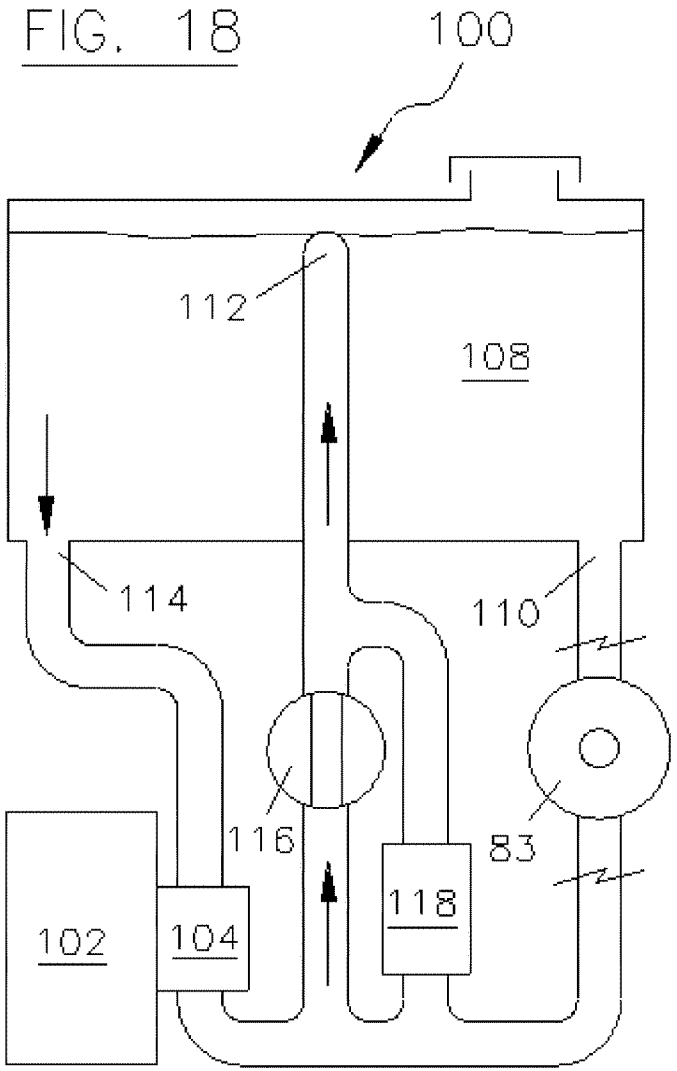
FIG. 18 is the same as FIG. 16 except that it shows how this new circuit functions when the engine is running and there is no power being applied to the wench.

FIG. 18 is the same as FIG. 16 except that the motor/engine 102 is operating and the pump 104 which is receiving fluid from port 114 and pumping it through throttle valve 116 and port 112 into the top of tank 108, ready to start powering motor/pump 83.

Figure 19:
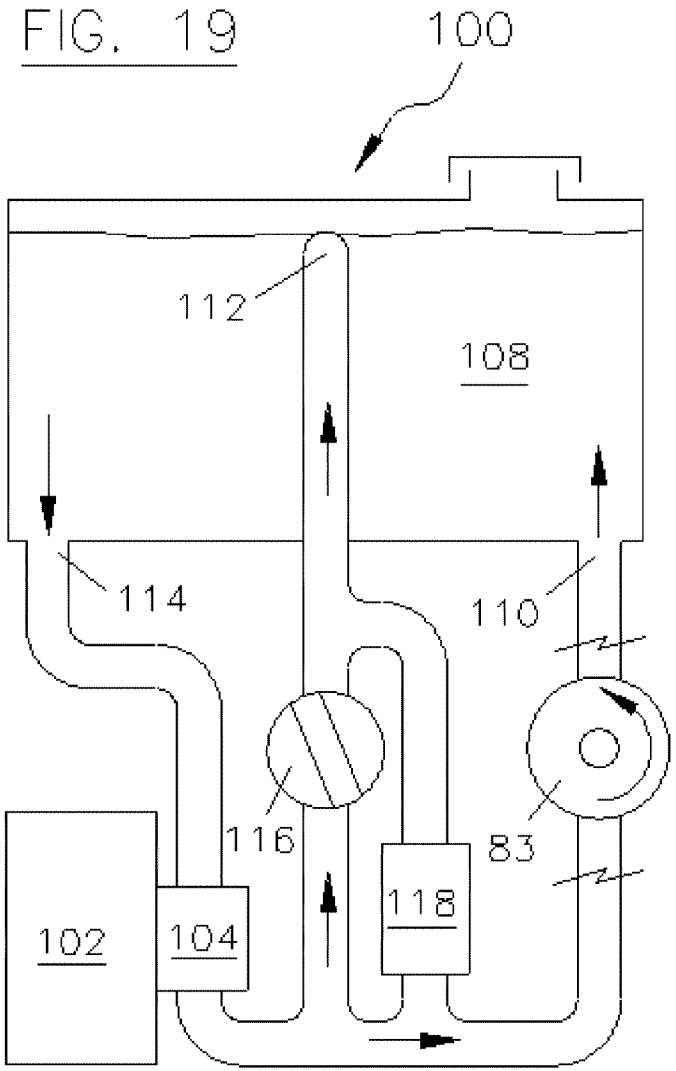
FIG. 19 is the same as FIG. 18 except that it shows how effective this new circuit is when the engine is running and the power to the wench is being regulated by the throttle valve.

FIG. 19 is the same as FIG. 16 except that the throttle valve 116 is beginning to close which applies pressure to the motor/pump 83 causing it to operate as a motor and pull up the cleaning tool 70 of FIG. 13 or the tubular seal assembly 10 of FIG. 1 with a column of crude oil above it from the bottom of the well 16. Until the valve 116 closes it can control the torque and speed of motor 83 but once it is closed the motor/engine 102 can control the motor 83 and winch 80.

A method for crude oil production includes the steps of dropping a well casing cleaning tool on an end of a cable, down into a bottom of said well casing, scraping foreign material off an inside surface of said well casing, pushing a first portion of said foreign material into a hollow center of said well casing cleaning tool and a second portion of said foreign material passing around the outside of said well casing cleaning tool, a cable winder winding said cable back on a drum, lowering a lipless tubular oil seal assembly on the cable down into said well casing and into oil residing at the bottom of the well casing, and lifting said lipless tubular oil seal assembly and thereby extracting oil from said well casing. The method may further include chemical treatment tool configured to be lowered down into the well casing and utilizing at least two tubular seals one of which slides up and down on a rigid tube to push chemicals into the oil formation when chemical treatment is deemed necessary.

While the invention herein disclosed has been described by means of specific embodiments and applications thereof, numerous modifications and variations could be made thereto by those skilled in the art without departing from the scope of the invention set forth in the claims.

I claim:

1. A crude oil production method and the applicable tooling comprising:

dropping a well casing cleaning tool on an end of a cable, into a well casing, the well casing cleaning tool including an outside surface and circumferentially spaced apart teeth on the outside surface, at least some of the teeth at a common vertical position on the outside surface;

the well casing cleaning tool scraping foreign material off an inside surface of said well casing as the well casing cleaning tool drops through the well casing;

a cable winch winding said cable back on a drum to lift the well casing cleaning tool;

lowering a tubular oil seal assembly on the cable down into said well casing and into oil residing inside the well casing; and lifting said tubular oil seal assembly and thereby extracting oil from said well casing, wherein part of the foreign material is scraped into the well casing cleaning tool and a remaining portion of the foreign material passes around the well casing cleaning tool.

2. The method of claim 1, further including:

lowering a chemical treatment tool into the well casing when needed, the chemical treatment tool utilizing at least two tubular seal assemblies, comprising a fixed lower tubular seal assembly a sliding tubular seal assembly which slides down on a hollow rigid tube to push chemicals into the oil formation, or a fixed upper tubular seal assembly and the sliding tubular seal assembly which slides up on the hollow rigid tube to push chemicals into the oil formation; and wherein oil flows through the hollow rigid tube while the chemical treatment tool is lowering into the well casing.

3. An apparatus for extracting crude oil from a well casing, the apparatus comprising:

an oil well cleaning tool having an outside surface and circumferentially spaced apart teeth on the outside surface, at least some of the teeth at a common vertical position on the outside surface, the teeth to scrape foreign material off an inside surface of a well casing and configured to push part of said foreign material into a hollow center of said well cleaning tool and the remaining portion of the foreign material around the outside of said well cleaning tool;

a powered cable winch configured to wind said cable back on a drum; and a tubular seal assembly configured to be lowered down into the well casing using the cable and into crude oil in said well casing and attached to said cable to lift said crude oil to the surface.

4. The apparatus of claim 3, wherein the tubular oil seal assembly includes a tubular seal without a lip which can be lowered down into the crude oil in a well and can lift said oil to the surface without said tubular oil seal jamming in said well.

5. The apparatus of claim 3, further including a chemical treatment tool including at least two tubular seal assemblies, one of the tubular seal assemblies slides up and down on a rigid tube to push chemicals into the oil formation and the other tubular seal assembly is a fixed seal, wherein the tubular seal assemblies reside on a hollow tube configured to allow oil to pass through the hollow tube when the chemical treatment tool is lowered into the well casing.

6. The apparatus of claim 3, wherein the winch winds said cable back on its drum properly due to at least three rollers pressing the cable tightly against said drum and a rigid tube around said cable between the cable winder and said drum; even when there is a slack in the cable coming into said winch.

7. The apparatus of claim 3, wherein:

the winch is a hydraulic powered cable winch; and a hydraulic power supply powers the hydraulic powered cable winch to raise the oil well cleaning tool on said cable out of the well casing, but can allow said oil well cleaning tool to drop down into said well casing at controlled speeds without over heating the fluid by supplying the motor/pump on said winch with fluid from a port at the bottom of the tank at the opposite end from the normal supply port.

8. The crude oil production method of claim 1, wherein half the foreign material is scraped into the well casing cleaning tool and a remaining portion of the foreign material passes around the well casing cleaning tool.

9. The crude oil production method of claim 1, wherein the teeth of the well casing cleaning tool comprise:

a first set of circumferentially spaced apart teeth and holes through the outside surface aligned with the first set of circumferentially spaced apart teeth; and a second set of circumferentially spaced apart teeth, individual second teeth of the second set of circumferentially spaced apart teeth spaced to reside circumferentially between individual first teeth of the first set of angularly spaced apart teeth; and scraping foreign material off an inside surface of said well casing comprises the first set of circumferentially spaced apart teeth scraping half the foreign matter from the well casing and through the holes into the well casing cleaning tool.

10. The crude oil production method of claim 1, wherein winding said cable back on a drum includes:

guiding the cable through a rigid tube between the cable winder and said drum; and at least three rollers tightly pressing the cable against said drum.

11. The crude oil production method of claim 1, wherein a chemical treatment tool is attachable to said cable as needed, the method further including:

lowering the chemical treatment tool into the well casing by said cable; and a sliding tubular seal assembly sliding towards a fixed tubular seal assembly to push chemicals into the oil formation.

12. The apparatus of claim 3, wherein the cable winch including at least three rollers pressed tightly against said drum and a rigid tube around said cable between a cable winder and said drum.

13. The apparatus of claim 3, further including a hydraulic power supply powering said winch to raise tools attached to said cable out of said well casing, and to drop down said tools into said well at controlled speeds without over heating the fluid by supplying the motor/pump on said winch with fluid from the port at the bottom of a tank at the opposite end from the normal supply port.

14. The apparatus of claim 3, wherein:

the well casing cleaning tool includes a first set of circumferentially spaced apart teeth; holes aligned with the first set of circumferentially spaced apart teeth; and a second set of circumferentially spaced apart teeth, individual second teeth of the second set of circumferentially spaced apart teeth spaced to reside circumferentially angularly between individual first teeth of the first set of circumferentially spaced apart teeth.

15. The apparatus of claim 3, wherein:

a first set of the circumferentially spaced apart teeth comprise two vertically spaced apart first sets of first teeth; and a second set of the circumferentially spaced apart teeth comprise two vertically spaced apart second sets of second teeth; and the first set of circumferentially spaced apart first teeth and second set of circumferentially spaced second apart teeth combine to scrape nearly an entire inner surface of the well casing.

16. The apparatus of claim 14, wherein holes are circumferentially aligned and leading each of the first teeth.

17. The apparatus of claim 3, wherein:

the tubular seal assembly includes a convex tubular seal making contact with the well casing; and the convex tubular seal slides vertically on a stud in the tubular seal assembly between an upper position while the tubular seal assembly is lowed into the well casing allowing the tubular seal assembly to pass through oil, and a lower position when the tubular seal assembly is lifted not allowing the tubular seal assembly to pass through the oil to lift the oil from the well casing.

18. The apparatus of claim 17, wherein tubular seal has a greater diameter than other parts of the tubular seal assembly.

19. The apparatus of claim 17, wherein tubular seal assembly is lipless.

20. The apparatus of claim 17, wherein an interior of the convex tubular seal is in fluid communication with a portion of the well casing interior above the tubular seal assembly, and fluid communication between the interior of the convex tubular seal and a portion of the well casing interior below the tubular seal assembly is restricted, to increase pressure inside the convex tubular seal to increase the sealing of the convex tubular seal to the well casing when the tubular seal assembly is lifted inside the well casing.

* * * * *